US008136462B2

(12) United States Patent
Lin

(10) Patent No.: US 8,136,462 B2
(45) Date of Patent: Mar. 20, 2012

(54) QUICK AND EASY ASSEMBLY SHELVING UNIT AND METHOD FOR ASSEMBLING THE SAME

(76) Inventor: Shih-Ming Lin, Dongguan (CN)

( * ) Notice: Subject to any disclaimer, the term of this patent is extended or adjusted under 35 U.S.C. 154(b) by 549 days.

(21) Appl. No.: 12/391,481

(22) Filed: Feb. 24, 2009

(65) Prior Publication Data

US 2010/0116764 A1 May 13, 2010

(30) Foreign Application Priority Data

Nov. 12, 2008 (CN) ..... 2008 2 0203255 U

(51) Int. Cl.
*A47B 91/00* (2006.01)

(52) U.S. Cl. ..... 108/193; 312/7.2; 312/258

(58) Field of Classification Search ..... 312/7.2, 312/258, 262, 257.1, 263; 108/115, 193, 108/180, 187, 184; 211/186, 189, 149, 150, 211/134, 195, 104; 16/387, 386; 248/220.1
See application file for complete search history.

(56) References Cited

U.S. PATENT DOCUMENTS

| | | | | |
|---|---|---|---|---|
| 2,030,858 | A * | 2/1936 | Dobson | 312/284 |
| 2,516,935 | A * | 8/1950 | Weaver | 16/50 |
| 2,932,343 | A * | 4/1960 | La Brut | 312/262 |
| 3,527,340 | A * | 9/1970 | Cipolla | 206/278 |
| 5,904,104 | A * | 5/1999 | Yu | 108/116 |
| 7,337,732 | B2 * | 3/2008 | Becker et al. | 108/193 |
| 7,913,863 | B2 * | 3/2011 | Lin | 211/186 |
| 2006/0054754 | A1 * | 3/2006 | Liberman et al. | 248/172 |
| 2006/0230993 | A1 * | 10/2006 | Becker et al. | 108/180 |
| 2007/0215012 | A1 * | 9/2007 | Fridley et al. | 108/50.01 |
| 2010/0122964 | A1 * | 5/2010 | Lin | 211/149 |
| 2010/0126952 | A1 * | 5/2010 | Huang | 211/134 |
| 2011/0017692 | A1 * | 1/2011 | Marietta et al. | 211/195 |

* cited by examiner

*Primary Examiner* — Janet M Wilkens

(74) *Attorney, Agent, or Firm* — Alan Kamrath; Kamrath IP Lawfirm, PA

(57) ABSTRACT

A shelving unit includes a support frame and a plurality of support boards each detachably mounted on the support frame. The support frame includes a first support bracket, a second support bracket located opposite to the first support bracket, two connecting braces each pivotally mounted between the first side of the first support bracket and the first side of the second support bracket, and a connecting plate having a first side pivotally mounted on the second side of the first support bracket and a second side detachably mounted on the second side of the second support bracket. Thus, the shelving unit can be assembled and disassembled easily and quickly without using tools, thereby facilitating a user on saving a considerable amount of time and inconvenience to assemble the shelving unit. In addition, the shelving unit can be folded before assembly facilitates on reducing the cost of packaging, transportation and storage of the shelving unit.

13 Claims, 9 Drawing Sheets

QUICK AND EASY ASSEMBLY SHELVING UNIT AND METHOD FOR ASSEMBLING THE SAME

BACKGROUND OF THE INVENTION

1. Field of the Invention

The present invention relates to a quick and easy assembly shelving unit and, more particularly, to a quick and easy assembly shelving unit to display and store an electronic video or audio appliance, such as a television, video player, speaker and the like.

2. Description of the Related Art

A conventional shelving unit comprises a shelving unit body having an inner portion provided with a plurality of partitions to receive a plurality of electronic appliances, such as video players, speakers and the like. In addition, a television can be placed on the top of the shelving unit body. However, the conventional shelving unit is either in a fully assembled construction or in a knock-down construction and has many shortcomings which dissuades consumers from buying it. For fully assembled construction, it cannot be folded so that the shelving unit has a larger overall volume and occupies a larger storage space. For knock-down construction, it requires tools and takes a considerable amount of time for assembly and disassembly. Therefore, conventional shelving unit causes inconvenience to a user in packaging, transportation and storage of the shelving unit and increasing the cost of fabrication.

BRIEF SUMMARY OF THE INVENTION

In accordance with the present invention, there is provided a shelving unit, comprising a support frame and a plurality of support boards each detachably mounted on the support frame. The support frame includes a first support bracket having a first side and a second side, a second support bracket located opposite to the first support bracket and having a first side and a second side, two connecting braces each pivotally mounted between the first side of the first support bracket and the first side of the second support bracket, and a connecting plate having a first side pivotally mounted on the second side of the first support bracket and a second side detachably mounted on the second side of the second support bracket.

The primary objective of the present invention is to provide a shelving unit that is foldable while transporting or when not in use.

Another objective of the present invention is to provide a shelving unit that can be assembled and disassembled easily and quickly without using tools, thereby greatly facilitating a user on saving a considerable amount of time to assemble and disassemble the shelving unit.

A further objective of the present invention is to provide a shelving unit, wherein the support frame of the shelving unit can be folded to have a smaller volume to decrease the cost of packaging, transportation and storage of the shelving unit.

A further objective of the present invention is to provide a shelving unit that can be folded when not in use, thereby facilitating the user storing and moving the shelving unit.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
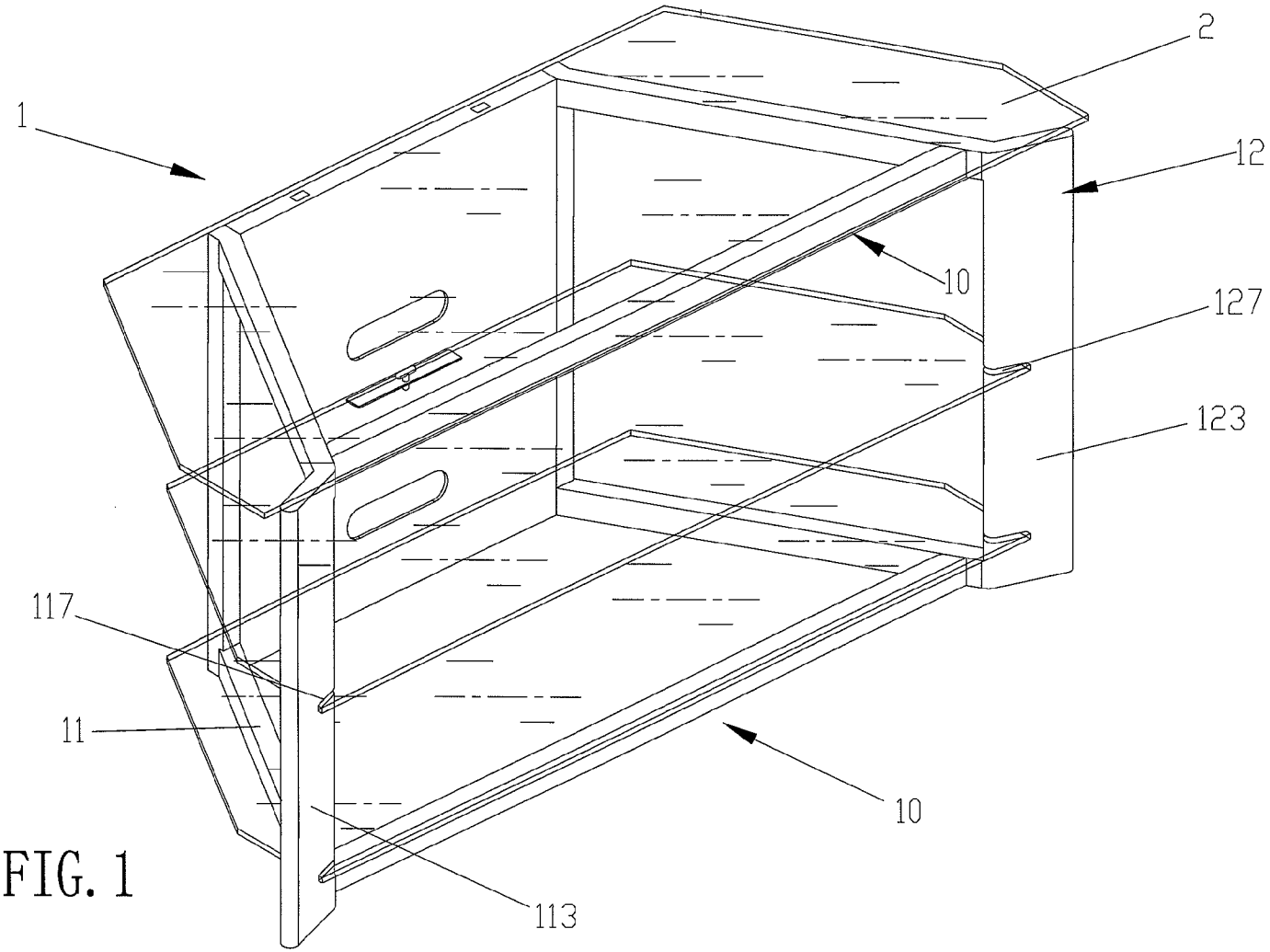
FIG. 1 is a front perspective view of a shelving unit in accordance with the preferred embodiment of the present invention.

Referring to the drawings and initially to FIGS. 1-9, a shelving unit in accordance with the preferred embodiment of the present invention comprises a support frame 1, and a plurality of support boards 2 each detachably mounted on the support frame 1.

The support frame 1 includes a first support bracket 11 having a first side 113 and a second side 114, a second support bracket 12 located opposite to the first support bracket 11 and having a first side 123 and a second side 124, two connecting braces 10 each pivotally mounted between the first side 113 of the first support bracket 11 and the first side 123 of the second support bracket 12, and a connecting plate 13 having a first side 135 pivotally mounted on the second side 114 of the first support bracket 11 and a second side 136 detachably mounted on the second side 124 of the second support bracket 12.

Each of the two connecting braces 10 has two opposite ends each provided with a hollow pivot seat 102. The pivot seat 102 of each of the two connecting braces 10 has an inner portion provided with a mounting recess 100 and has two opposite sides each provided with a fixing hole 103 connected to the mounting recess 100.

The first support bracket 11 has an inner portion provided with an opening 116 located between the first side 113 and the second side 114 of the first support bracket 11. The first support bracket 11 has a periphery provided with a plurality of retaining grooves 117 to retain the support boards 2. The first side 113 of the first support bracket 11 has two opposite ends each provided with a protruding first pivot ear 111 pivotally connected with the pivot seat 102 of the respective connecting brace 10. The first pivot ear 111 of the first support bracket 11 is pivotally mounted in the mounting recess 100 of the pivot seat 102 of the respective connecting brace 10 and has an inner portion provided with a pivot hole 115. The second side 114 of the first support bracket 11 has two opposite ends each provided with a protruding first hinge 112.

The second support bracket 12 has a size equal to that of the first support bracket 11 and has an inner portion provided with an opening 126 located between the first side 123 and the second side 124 of the second support bracket 12. The second support bracket 12 has a periphery provided with a plurality of retaining grooves 127 to retain the support boards 2. The first side 123 of the second support bracket 12 has two opposite ends each provided with a protruding second pivot ear 121 pivotally connected with the pivot seat 102 of the respective connecting brace 10. The second pivot ear 121 of the second support bracket 12 is pivotally mounted in the mounting recess 100 of the pivot seat 102 of the respective connecting brace 10 and has an inner portion provided with a pivot bore 125. The second side 124 of the second support bracket 12 has two opposite ends each provided with a movable fastening knob 122.

The support frame 1 further includes two first pivot pins 101 each extending through the fixing hole 103 of the pivot seat 102 of the respective connecting brace 10 and the pivot hole 115 of the respective first pivot ear 111 of the first support bracket 11 so that the respective first pivot ear 111 of the first support bracket 11 is pivotally connected with the pivot seat 102 of the respective connecting brace 10, and two second pivot pins 104 each extending through the fixing hole 103 of the pivot seat 102 of the respective connecting brace 10 and the pivot bore 125 of the respective second pivot ear 121 of the second support bracket 12 so that the respective second pivot ear 121 of the second support bracket 12 is pivotally connected with the pivot seat 102 of the respective connecting brace 10.

The connecting plate 13 is parallel with the two connecting braces 10 and has a length smaller than that of each of the two connecting braces 10, so that the first support bracket 11 and the second support bracket 12 are located between the connecting plate 13 and the two connecting braces 10 in an oblique manner, and the support frame 1 has a substantially trapezium profile. The connecting plate 13 has a top provided with two locking holes 133. The first side 135 of the connecting plate 13 has two opposite ends each provided with a protruding second hinge 132 pivotally connected with the respective first hinge 112 of the first support bracket 11 so that the first side 135 of the connecting plate 13 is pivotally mounted on the second side 114 of the first support bracket 11. The second side 136 of the connecting plate 13 has two opposite ends each provided with a protruding locking piece 131 mounted on and detachably locked by the respective fastening knob 122 of the second support bracket 12 so that the second side 136 of the connecting plate 13 is detachably mounted on the second side 124 of the second support bracket 12.

Each of the support boards 2 is located between the first support bracket 11, the second support bracket 12, the two connecting braces 10 and the connecting plate 13 to support an electric or electronic appliance, such as a television, video player, sound and the like. A top one of the support boards 2 has a bottom provided with two protruding movable locking knobs 21 each detachably locked in the respective locking hole 133 of the connecting plate 13.

Figure 2:
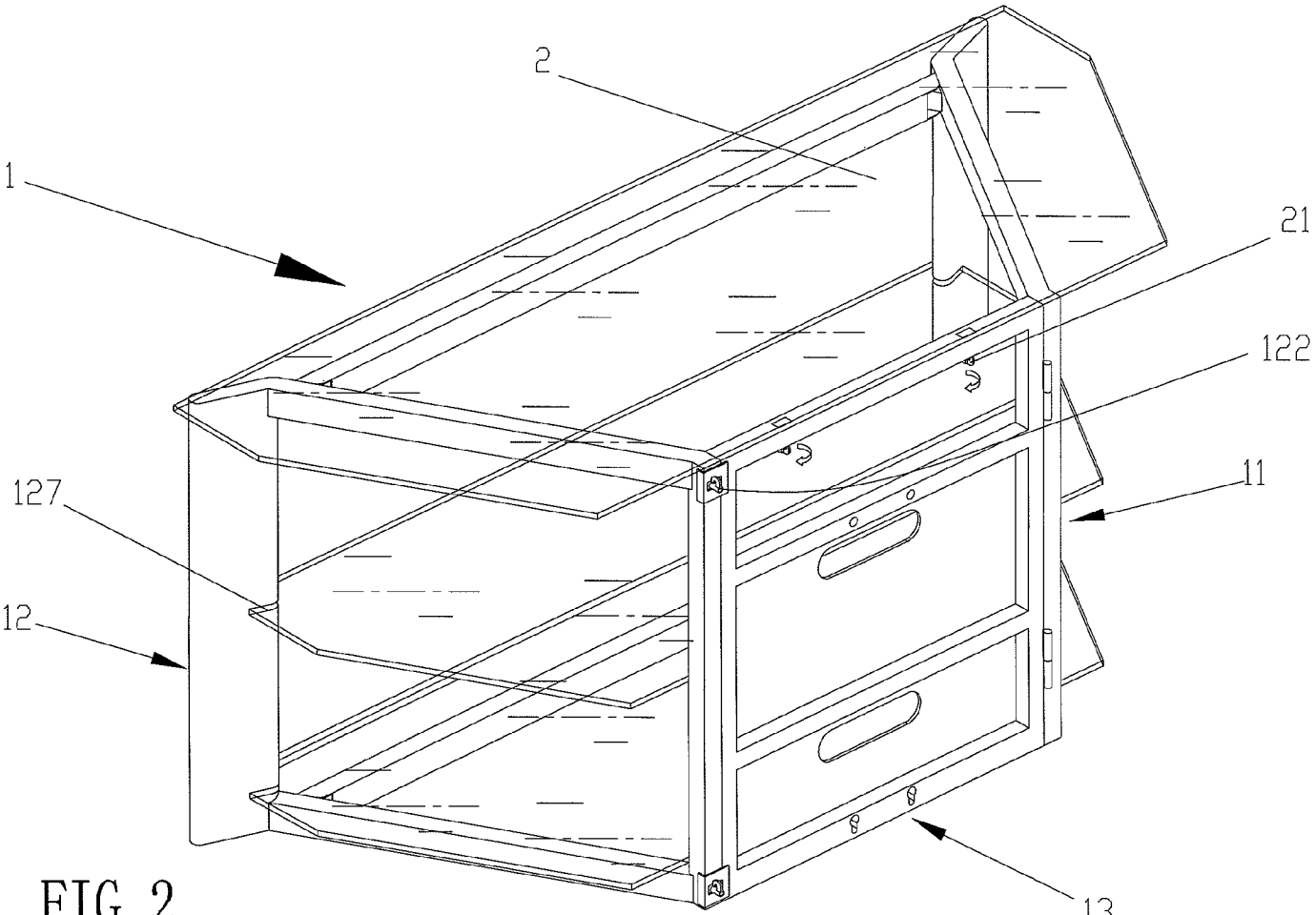
FIG. 2 is a rear perspective view of the shelving unit as shown in FIG. 1.
Figure 3:
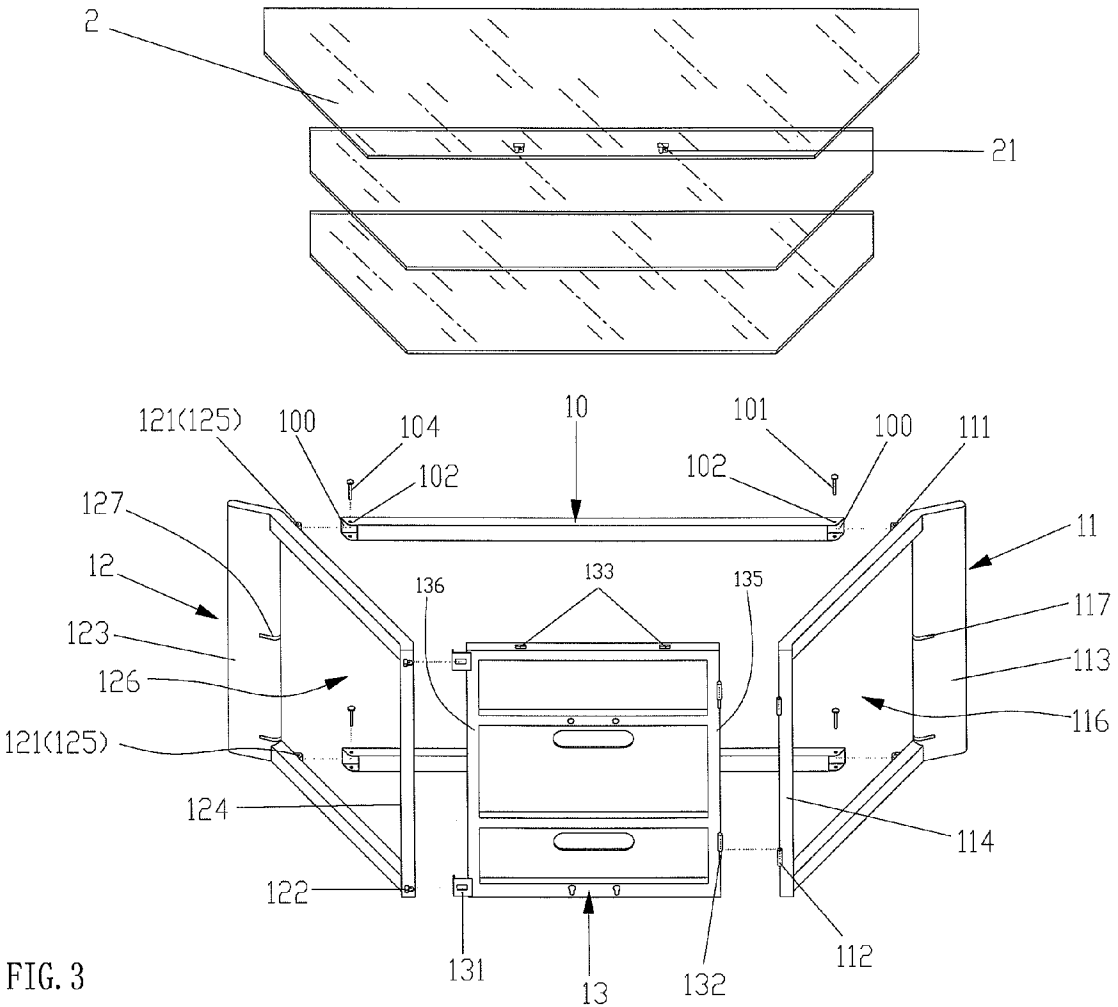
FIG. 3 is an exploded perspective view of the shelving unit as shown in FIG. 2.
Figure 4:
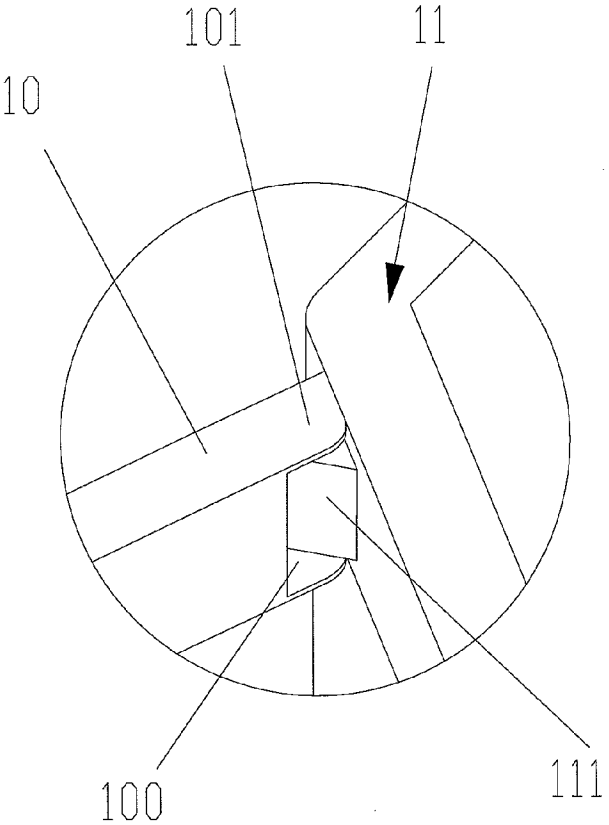
FIG. 4 is a partially perspective view of the shelving unit as shown in FIG. 2.
Figure 5:
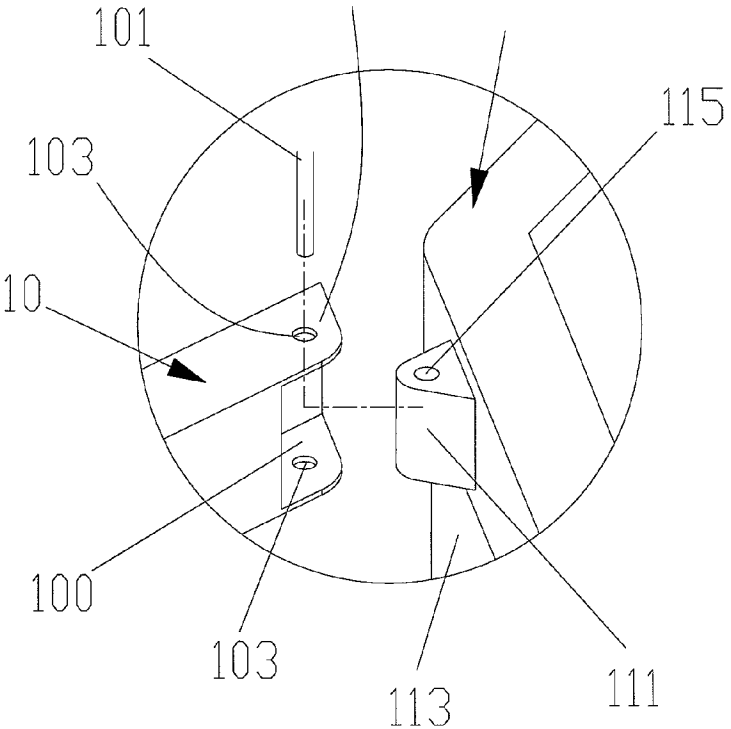
FIG. 5 is an exploded perspective view of the shelving unit as shown in FIG. 4.
Figure 6:
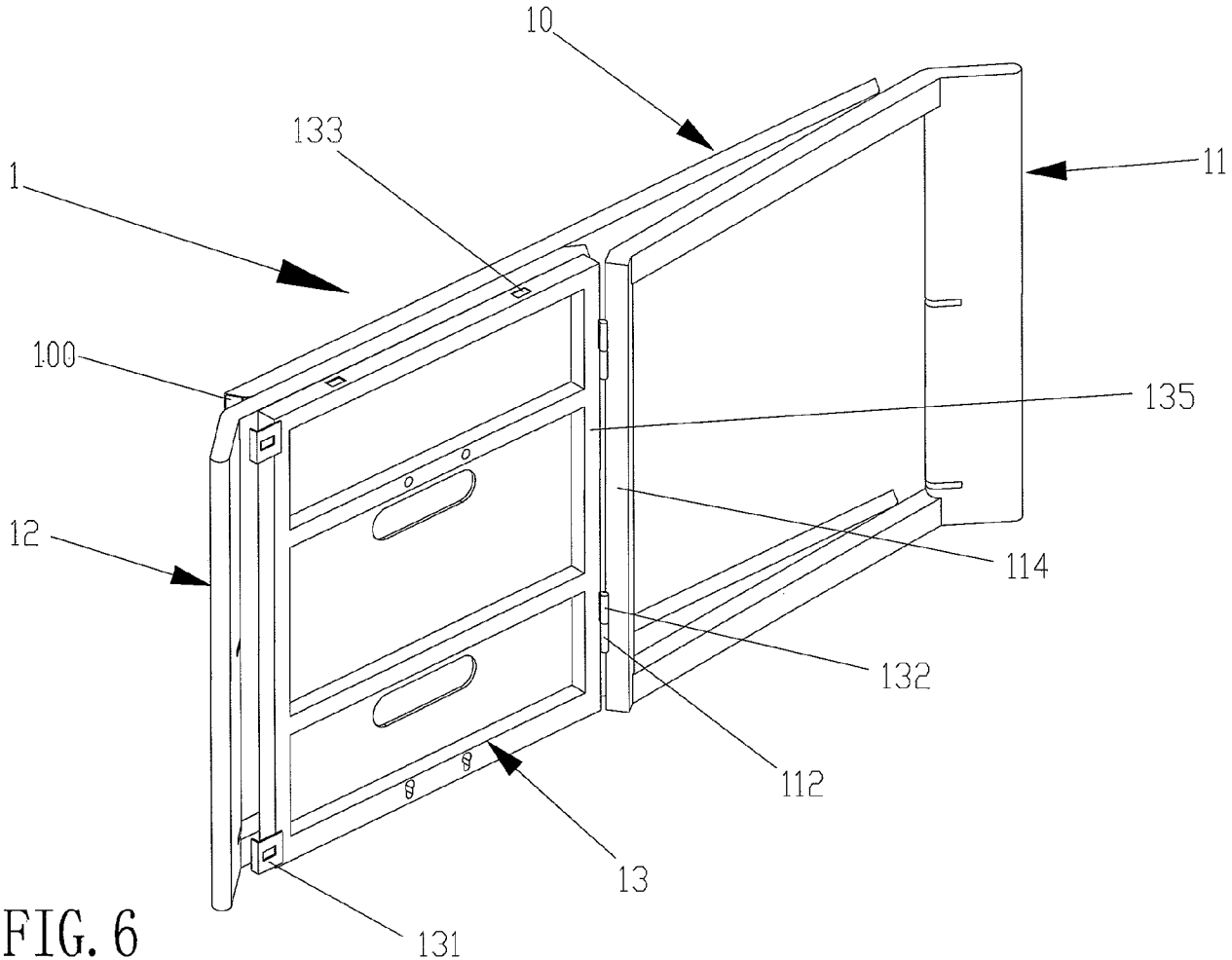
FIG. 6 is a perspective folded view of the shelving unit as shown in FIG. 2.
Figure 7:
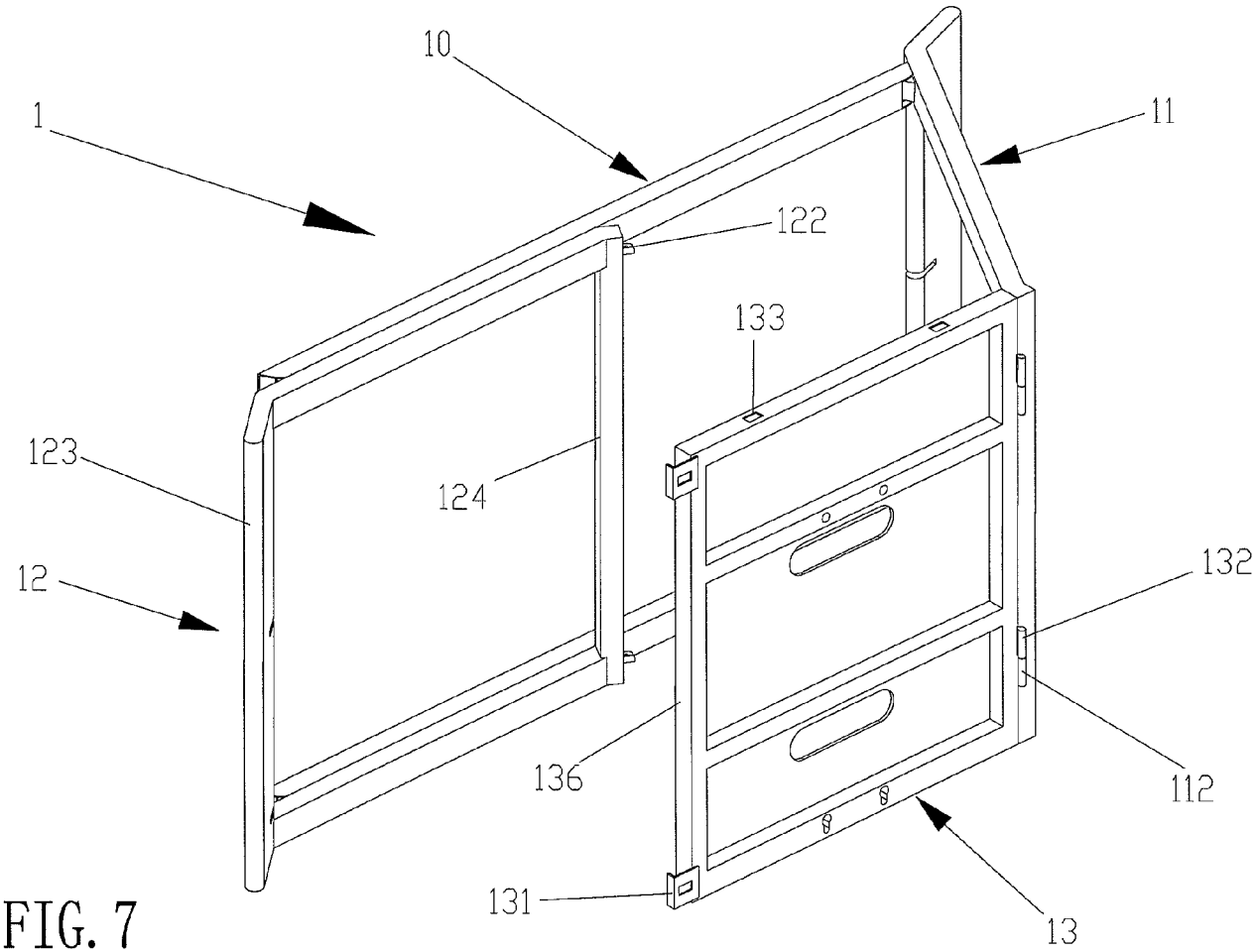
FIG. 7 is a perspective assembly view of the shelving unit as shown in FIG. 6.
Figure 8:
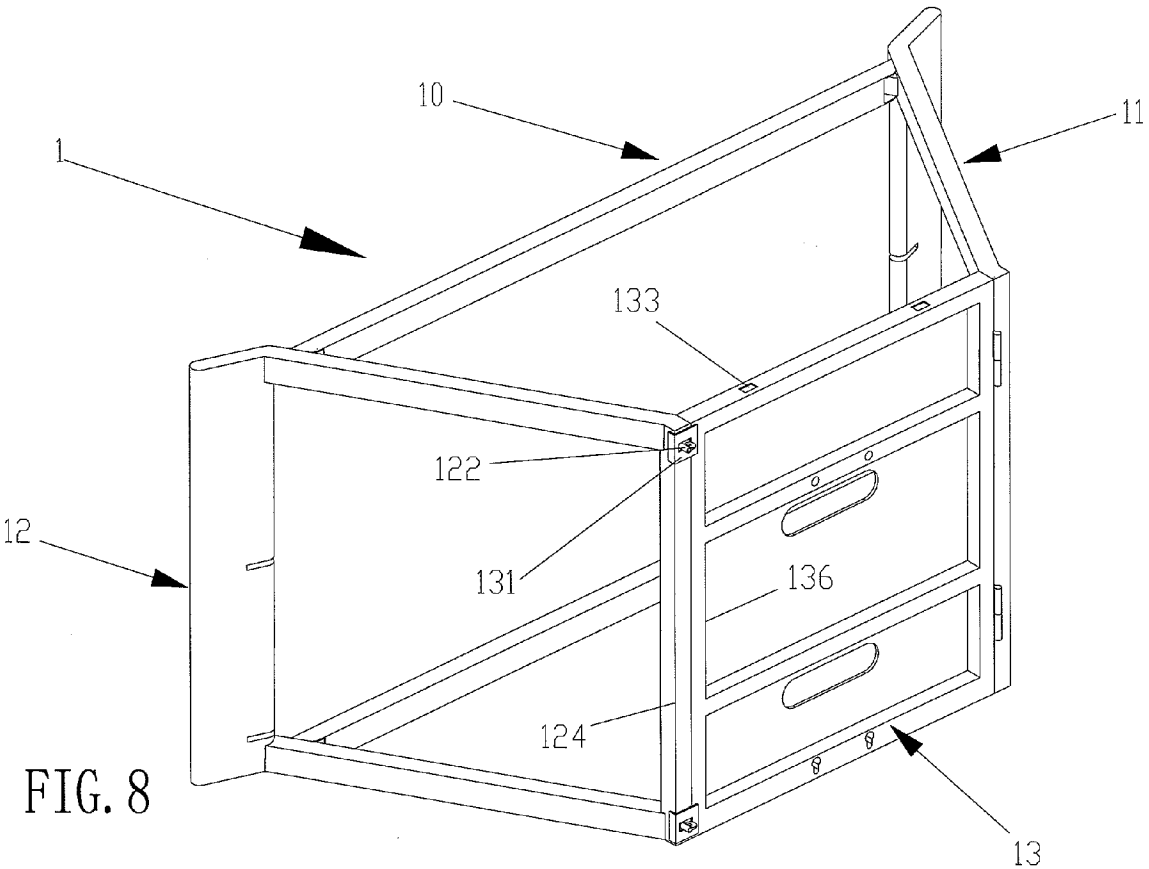
FIG. 8 is a perspective assembly view of the shelving unit as shown in FIG. 7.
Figure 9:
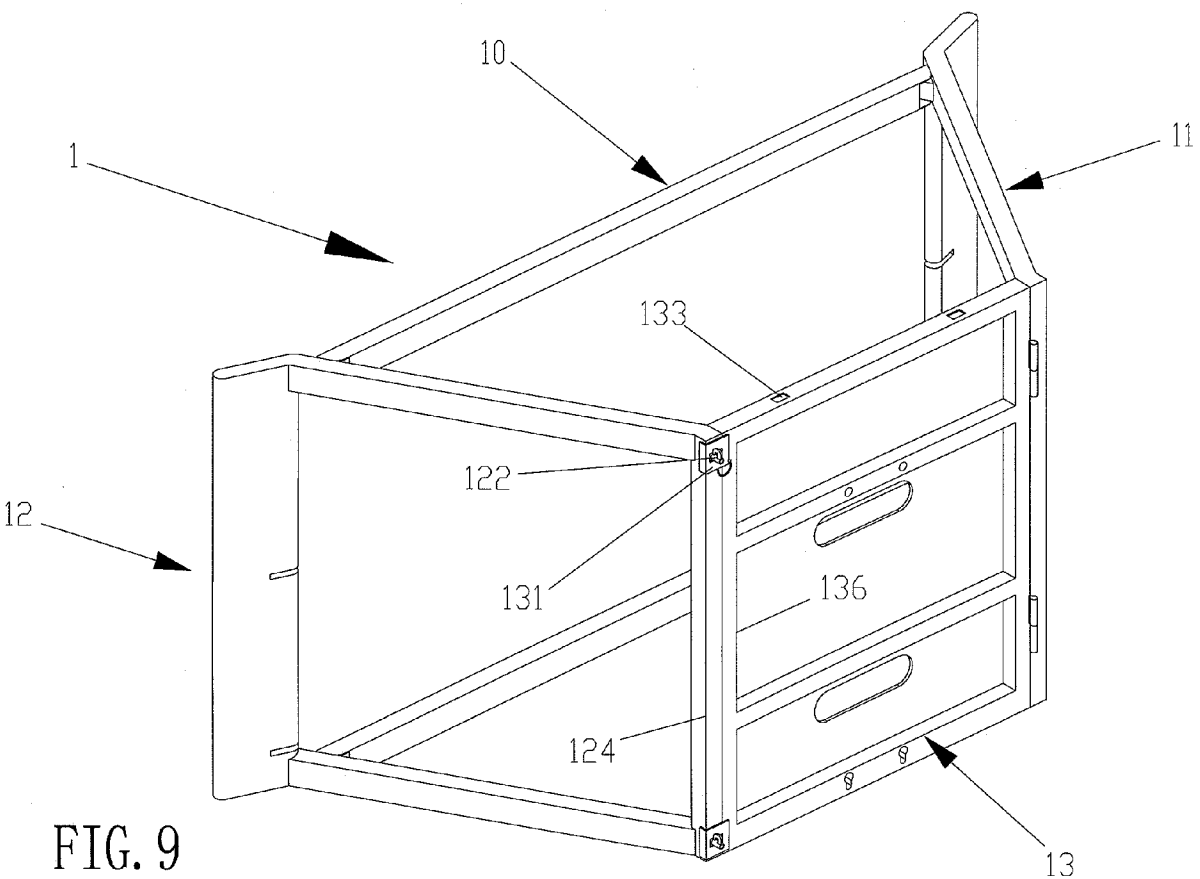
FIG. 9 is a schematic operational view of the shelving unit as shown in FIG. 8.

In assembly, referring to FIGS. 6-9 with reference to FIGS. 1-5, the two connecting braces 10 are pivotally connected with the first support bracket 11 and the second support bracket 12 by the first pivot pins 101 and the second pivot pins 104 respectively. Then, the first side 135 of the connecting plate 13 is pivotally mounted on the second side 114 of the first support bracket 11 as shown in FIGS. 6 and 7. Then, the locking piece 131 of the connecting plate 13 is mounted on the fastening knob 122 of the second support bracket 12 as shown in FIG. 8. Then, the fastening knob 122 of the second support bracket 12 is rotated relative to the locking piece 131 of the connecting plate 13 as shown in FIG. 9 to lock the locking piece 131 of the connecting plate 13 onto the fastening knob 122 of the second support bracket 12 so that the second side 136 of the connecting plate 13 is detachably locked onto the second side 124 of the second support bracket 12. Finally, each of the support boards 2 is inserted into the support frame 1 and retained between the first support bracket 11 and the second support bracket 12 so as to form the shelving unit as shown in FIGS. 1 and 2. At this time, each of the locking knobs 21 of the top one of the support boards 2 is rotated relative to the respective locking hole 133 of the connecting plate 13 to lock the top one of the support boards 2 onto the connecting plate 13.

On the contrary, after the support boards 2 are removed from the support frame 1, the locking piece 131 of the connecting plate 13 is unlocked from the fastening knob 122 of the second support bracket 12 so that the second side 136 of the connecting plate 13 can be detached from the second side 124 of the second support bracket 12 as shown in FIG. 7. Then, the second support bracket 12 is pivoted to rest on the two connecting braces 10 as shown in FIG. 7. Finally, the first support bracket 11 and the connecting plate 13 are pivoted to rest on the two connecting braces 10 and the second support bracket 12 respectively as shown in FIG. 6 so as to fold the support frame 1.

Figure 10:
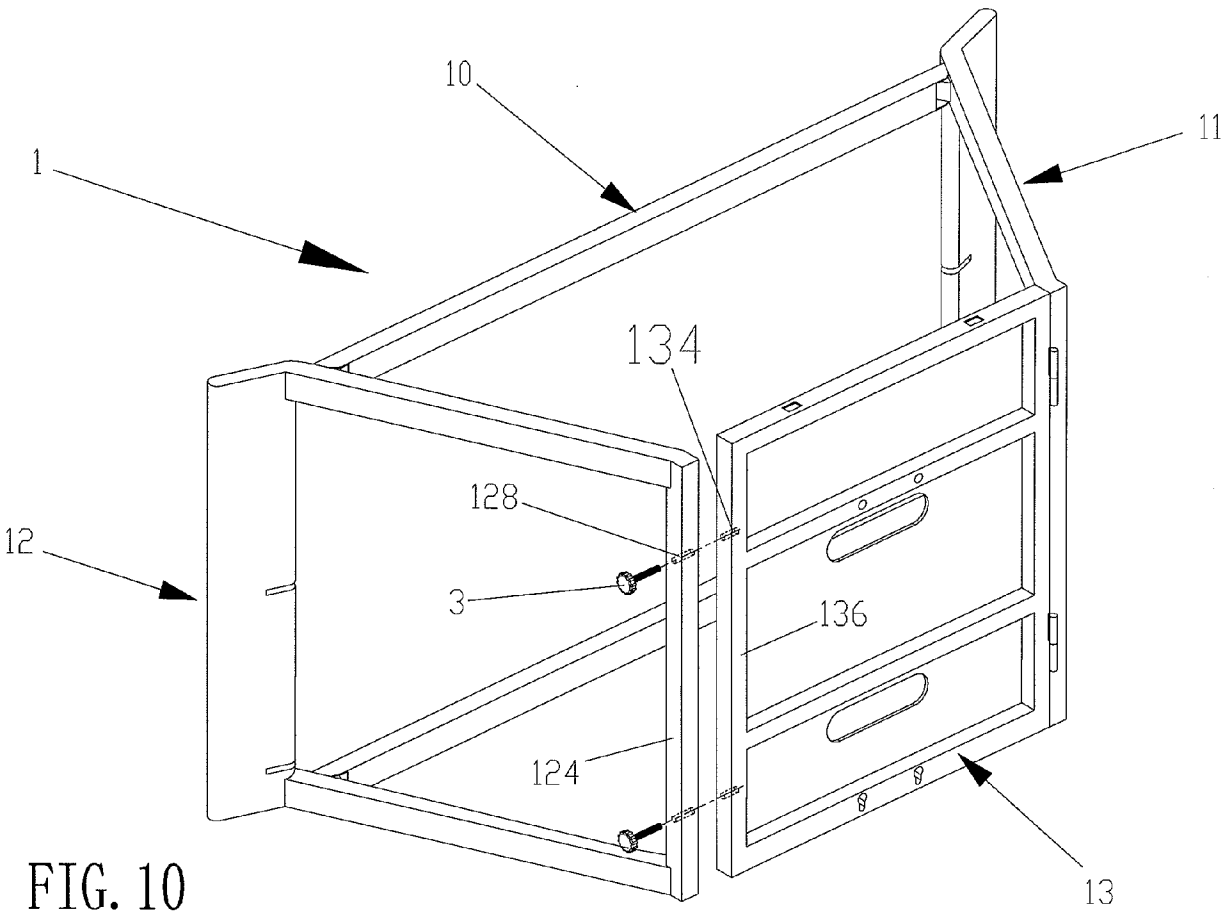
FIG. 10 is a partially perspective view of a shelving unit in accordance with another preferred embodiment of the present invention.

As shown in FIG. 10, the second side 124 of the second support bracket 12 has two opposite ends each provided with a through hole 128, the second side 136 of the connecting plate 13 has two opposite ends each provided with a screw bore 134, and the support frame 1 further includes two fastening bolts 3 each rotatably mounted on the second side 124 of the second support bracket 12 and each extending through the respective through hole 128 of the second support bracket 12 and each screwed into the respective screw bore 134 of the connecting plate 13 so that the second side 136 of the connecting plate 13 is detachably mounted on the second side 124 of the second support bracket 12.

Accordingly, the shelving unit can be assembled and disassembled easily and quickly without using tools, thereby greatly facilitating a user assembling and disassembling the shelving unit. In addition, the shelving unit can be folded before assembly to facilitate packaging, transportation and storage of the shelving unit and to decrease the cost. Further, the shelving unit can be folded when not in use, thereby facilitating the user storing and moving the shelving unit.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shelving unit, comprising:

a support frame;

a plurality of support boards each detachably mounted on the support frame; wherein the support frame includes:

a first support bracket having a first side and a second side;

a second support bracket located opposite to the first support bracket and having a first side and a second side;

two connecting braces each pivotally mounted between the first side of the first support bracket and the first side of the second support bracket;

a connecting plate having a first side pivotally mounted on the second side of the first support bracket and a second side detachably mounted on the second side of the second support bracket;

wherein each of the two connecting braces has two opposite ends each provided with a hollow pivot seat;

the first side of the first support bracket has two opposite ends each provided with a protruding first pivot ear pivotally connected with the pivot seat of the respective connecting brace;

the first side of the second support bracket has two opposite ends each provided with a protruding second pivot ear pivotally connected with the pivot seat of the respective connecting brace;

the pivot seat of each of the two connecting braces has an inner portion provided with a mounting recess;

the first pivot ear of the first support bracket is pivotally mounted in the mounting recess of the pivot seat of the respective connecting brace;

the second pivot ear of the second support bracket is pivotally mounted in the mounting recess of the pivot seat of the respective connecting brace.

2. The shelving unit of claim 1, wherein the pivot seat of each of the two connecting braces has two opposite sides each provided with a fixing hole connected to the mounting recess;

the first pivot ear of the first support bracket has an inner portion provided with a pivot hole;

the second pivot ear of the second support bracket has an inner portion provided with a pivot bore;

the support frame further includes:

two first pivot pins each extending through the fixing hole of the pivot seat of the respective connecting brace and the pivot hole of the respective first pivot ear of the first support bracket so that the respective first pivot ear of the first support bracket is pivotally connected with the pivot seat of the respective connecting brace;

two second pivot pins each extending through the fixing hole of the pivot seat of the respective connecting brace and the pivot bore of the respective second pivot ear of the second support bracket so that the respective second pivot ear of the second support bracket is pivotally connected with the pivot seat of the respective connecting brace.

3. The shelving unit of claim 1, wherein the second side of the first support bracket has two opposite ends each provided with a protruding first hinge;

the first side of the connecting plate has two opposite ends each provided with a protruding second hinge pivotally connected with the respective first hinge of the first support bracket so that the first side of the connecting plate is pivotally mounted on the second side of the first support bracket.

4. The shelving unit of claim 1, wherein the second side of the second support bracket has two opposite ends each provided with a through hole;

the second side of the connecting plate has two opposite ends each provided with a screw bore;

the support frame further includes two fastening bolts each rotatably mounted on the second side of the second support bracket and each extending through the respective through hole of the second support bracket and each screwed into the respective screw bore of the connecting plate so that the second side of the connecting plate is detachably mounted on the second side of the second support bracket.

5. The shelving unit of claim 1, wherein the first support bracket has a periphery provided with a plurality of retaining grooves to retain the support boards.

6. The shelving unit of claim 1, wherein the second support bracket has a periphery provided with a plurality of retaining grooves to retain the support boards.

7. The shelving unit of claim 1, wherein each of the support boards is located between the first support bracket, the second support bracket, the two connecting braces and the connecting plate.

8. The shelving unit of claim 1, wherein the first support bracket has an inner portion provided with an opening located between the first side and the second side of the first support bracket.

9. The shelving unit of claim 1, wherein the second support bracket has an inner portion provided with an opening located between the first side and the second side of the second support bracket.

10. The shelving unit of claim 1, wherein the second support bracket has a size equal to that of the first support bracket.

11. The shelving unit of claim 10, wherein the connecting plate is parallel with the two connecting braces and has a length smaller than that of each of the two connecting braces;

the first support bracket and the second support bracket are located between the connecting plate and the two connecting braces in an oblique manner;

the support frame has a substantially trapezium profile.

12. A shelving unit, comprising:

a support frame;

a plurality of support boards each detachably mounted on the support frame. wherein the support frame includes:

a first support bracket having a first side and a second side;

a second support bracket located opposite to the first support bracket and having a first side and a second side;

two connecting braces each pivotally mounted between the first side of the first support bracket and the first side of the second support bracket;

a connecting plate having a first side pivotally mounted on the second side of the first support bracket and a second side detachably mounted on the second side of the second support bracket;

wherein the second side of the second support bracket has two opposite ends each provided with a movable fastening knob;

the second side of the connecting plate has two opposite ends each provided with a protruding locking piece mounted on and detachably locked by the respective fastening knob of the second support bracket so that the second side of the connecting plate is detachably mounted on the second side of the second support bracket.

13. A shelving unit, comprising:

a support frame;

a plurality of support boards each detachably mounted on the support frame; wherein the support frame includes:

a first support bracket having a first side and a second side;

a second support bracket located opposite to the first support bracket and having a first side and a second side;

two connecting braces each pivotally mounted between the first side of the first support bracket and the first side of the second support bracket;

a connecting plate having a first side pivotally mounted on the second side of the first support bracket and a second side detachably mounted on the second side of the second support bracket;

wherein the connecting plate has a top provided with two locking holes;

a top one of the support boards has a bottom provided with two protruding movable locking knobs each detachably locked in the respective locking hole of the connecting plate.

* * * * *